US005961254A

United States Patent [19]

Friedrichs

[11] Patent Number: 5,961,254

[45] Date of Patent: Oct. 5, 1999

[54] HYDRAULIC ADVANCING SUPPORT FRAME

[75] Inventor: Hans-Otto Friedrichs, Wuppertal, Germany

[73] Assignee: DBT Deutsch Bergbau-Technik GmbH, Germany

[21] Appl. No.: 08/916,615

[22] Filed: Aug. 22, 1997

[30] Foreign Application Priority Data

Aug. 19, 1996 [DE] Germany ..... 196 33 847

[51] Int. Cl.[6] ..... E21D 15/52

[52] U.S. Cl. ..... 405/297; 405/290

[58] Field of Search ..... 405/290, 291, 405/292, 293, 294, 295, 296, 297, 298, 299, 300, 301, 302, 303; 299/31, 32, 33

[56] References Cited

U.S. PATENT DOCUMENTS

| | | | |
|---|---|---|---|
| 4,600,340 | 7/1986 | Rosenberg | 405/297 |
| 4,940,363 | 7/1990 | Brown et al. | 405/296 |
| 4,978,248 | 12/1990 | Sprenger et al. | 405/297 |
| 5,039,257 | 8/1991 | Bithell | 405/297 |
| 5,100,263 | 3/1992 | Woodford et al. | 405/297 |
| 5,252,006 | 10/1993 | Plevak | 405/297 |

FOREIGN PATENT DOCUMENTS

| | | |
|---|---|---|
| 1 582 390 | 1/1981 | United Kingdom . |
| 2 231 610 | 11/1990 | United Kingdom . |
| 2 237 837 | 5/1991 | United Kingdom . |

*Primary Examiner*—David Bagnell
*Assistant Examiner*—Sunil Singh
*Attorney, Agent, or Firm*—Dorn, McEachran, Jambor & keating

[57] ABSTRACT

An advancing support frame is connected to the face conveyor (9) via an advancing rod (7) engaging with the advancing cylinder (5). A lifting cylinder (10) is supported on the advancing rod (7), with which the base shoes (1) are lifted during the advancing process. The lifting cylinder (10) is guided so as to be able to move in height in longitudinal guides (15) on the inner sides of the base shoes (1). A U-shaped tension stirrup (18), whose shanks (19) directed towards the ground have elongated holes (20), is supported centrally by the lifting cylinder (10) and joined to the base shoes (1) via carrying bolts (21) fastened to them.

6 Claims, 3 Drawing Sheets

18
16
21
10
12
13
1
7
20
21
13
1

HYDRAULIC ADVANCING SUPPORT FRAME

BACKGROUND OF THE INVENTION

Field of the Invention

The current invention relates to a hydraulic advancing support frame with a lifting cylinder to raise base shoes during the advancing process.

The mining of coal seams is carried out by an alternating sequence of winning coal using a mining machine, which is driven along the coal front on a face conveyor, and supporting the roof thereby exposed by hydraulic advancing support frames brought up on the goaf side of the conveyor, which follow the conveyor and move forward by steps onto the exposed cut floor of the seam. This process assumes an essentially even floor. Unevenness in the floor caused by the geology and soft ground rock can substantially hinder the stepping process, since the floor shoes come up against steps or sink into the ground. For these reasons lifting arrangements are employed, by which the forward ends of the base shoes are raised during the movement process.

An advancing support frame comprises as its main components base shoes, hydraulic props to support a roof canopy and a gob shield as well as an advancing arrangement with an advancing cylinder, which joins the support to the face conveyor at the mining face. The advancing cylinder is arranged between the base shoes of the powered support assembly and engages with the piston rod extending towards the goaf side on an advancing rod which is linked to the conveyor on the face side. A lifting cylinder to even out differences of level between the conveyor and the base shoes is mounted in an upright position on the base shoes and at its free end is supported with the extending piston rod on the advancing rod. During mining the lifting cylinder slides over the advancing rod which moves forward with the conveyor. The cylinder is lifted by upwards pivoting movements of the advancing rod on travelling over unevennesses in the ground, whereby the lifting cylinder is pushed in. During the process of advancing the lifting cylinder raises the forward ends of the base shoes and brings them again to the level of the advancing rod. In the same way the lifting cylinder prevents the tips of the base shoes from digging into soft ground.

Description of Related Art

A lifting arrangement is proposed in DE 40 35 252 A1, whose lifting cylinder, with its covering tube, is set into a strap-like holder positioned on the base shoe, which encloses the covering tube in a frictional grip. When the advancing rod pivots upwards the lifting cylinder can be pushed up a certain amount within the holder up to a stop and then be let down again. The roof canopy can thereby be driven in further by the sliding distance of the cylinder holder, so that the support frame obtains the desired compactness for transport purposes. The additional adjustment provided is however not great, especially so if the lifting cylinder is set beyond the extended position. Added to this substantial bending moments are applied to the piston rod of the lifting cylinder which slides on the advancing rod.

Summary of the Invention

It is the aim of the present invention to produce a lifting arrangement with a relatively large adjustment range, which has an improved low profile holder for the lifting cylinder.

Accordingly the present invention is directed to a hydraulic advancing support frame with two parallel base shoes as the mounting for a prop supporting a roof canopy, with an advancing cylinder supported on a cross-beam between the base shoes, whose extensible piston rod engages on the goaf side with an advancing rod, which is taken below the advancing cylinder and is linked on the face side to a face conveyor, and with a lifting cylinder supported on the advancing rod in an upright position for lifting the base shoes during the advancing process, in which the lifting cylinder is mounted in side guides on the base shoes so as to be able to slide in height and joined to them via a U-shaped tension stirrup, which is supported centrally by the lifting cylinder.

Advantageously the lifting cylinder is held by lateral guide lugs on the cylinder cover tube in vertically arranged longitudinal guides on the opposing inner sides of the base shoes so that it can slide in height and in which above the longitudinal guides, carrying bolts fixed on the inner sides of the base shoes engage in elongated holes in shanks of the tension stirrup directed towards the ground on both sides of the lifting cylinder.

Preferably the elongated holes in the tension stirrup have a length corresponding to the range of the lifting cylinder.

In a preferred embodiment the lifting cylinder is arranged on the face side of the cross beam.

The lifting arrangement of the advancing support frame according to the present invention can be adjusted from the retracted position of the lifting cylinder over a relatively wide pivoting range of the advancing rod. During the advance of the conveyor the lifted advancing rod effects a displacement of the retracted lifting cylinder in the longitudinal guides as well as in the elongated holes in the shanks of the tension stirrup. In the advance of the support the tension stirrup, lifted by the extending piston rod of the lifting cylinder, engages the carrying bolts in the lower radii of the elongated holes and lifts the base shoes to the level of the advancing beam. The lifting cylinder, under the action of the compressed medium, holds the base shoes at the level of the conveyor and in this way similarly prevents the tips of the shoes from sinking into soft ground rock.

The constructional height of the lifting arrangement is only a very small amount greater than the retracted cylinder. The favourable size permits the application of cylinders with relatively large stroke, which is especially favourable for support frames for small seam thickness. It is also favourable that the lifting cylinder is guided upright on the advancing rod in longitudinal guides of the base shoe, which relieves the lifting cylinder from cross forces.

BRIEF DESCRIPTION OF THE DRAWINGS

An example of an advancing support frame made in accordance with the present invention is described herein below with reference to the accompanying drawings, in which.

DETAILED DESCRIPTION OF THE INVENTION

Figure 1:
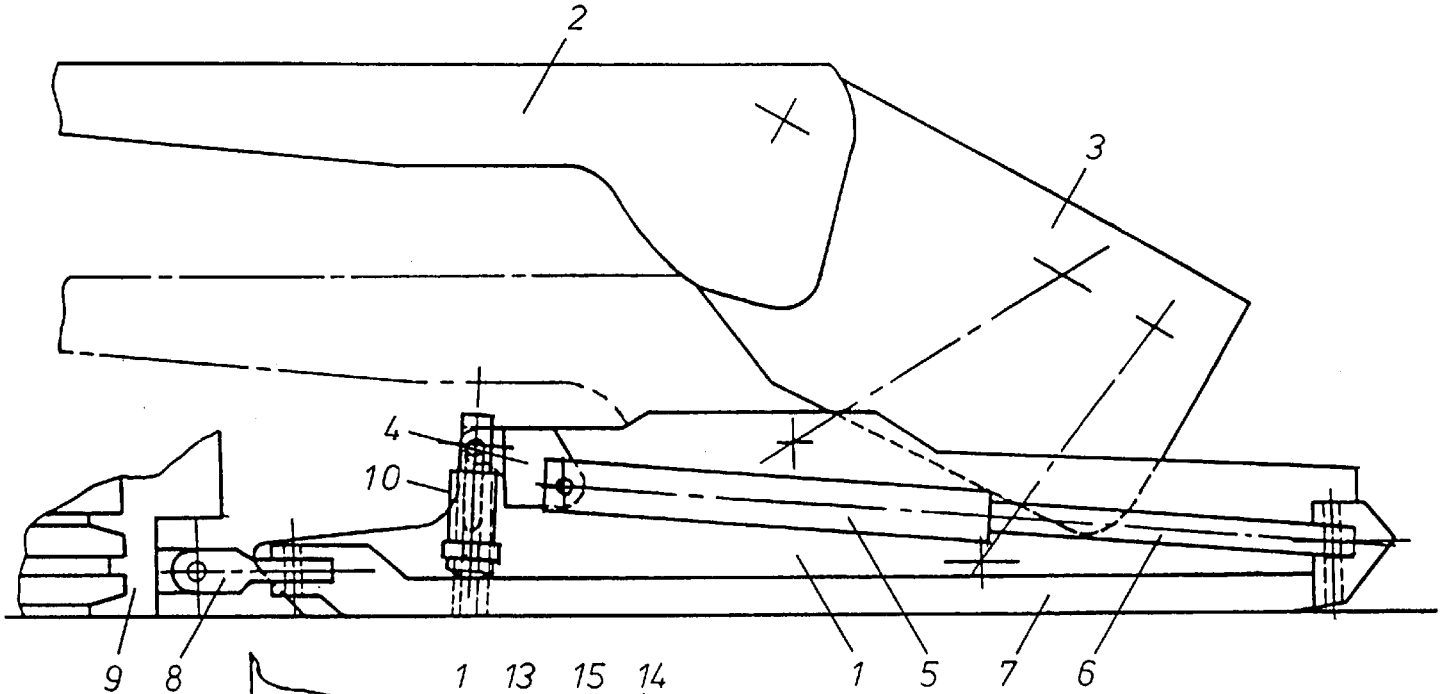
FIG. 1 shows a side view of an advancing support frame with a lifting arrangement.
Figure 2:
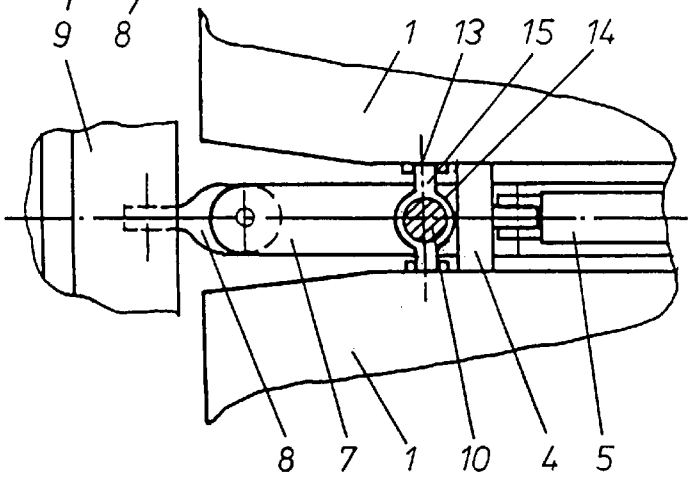
FIG. 2 shows a section of the lifting arrangement in plan view.
Figure 4:
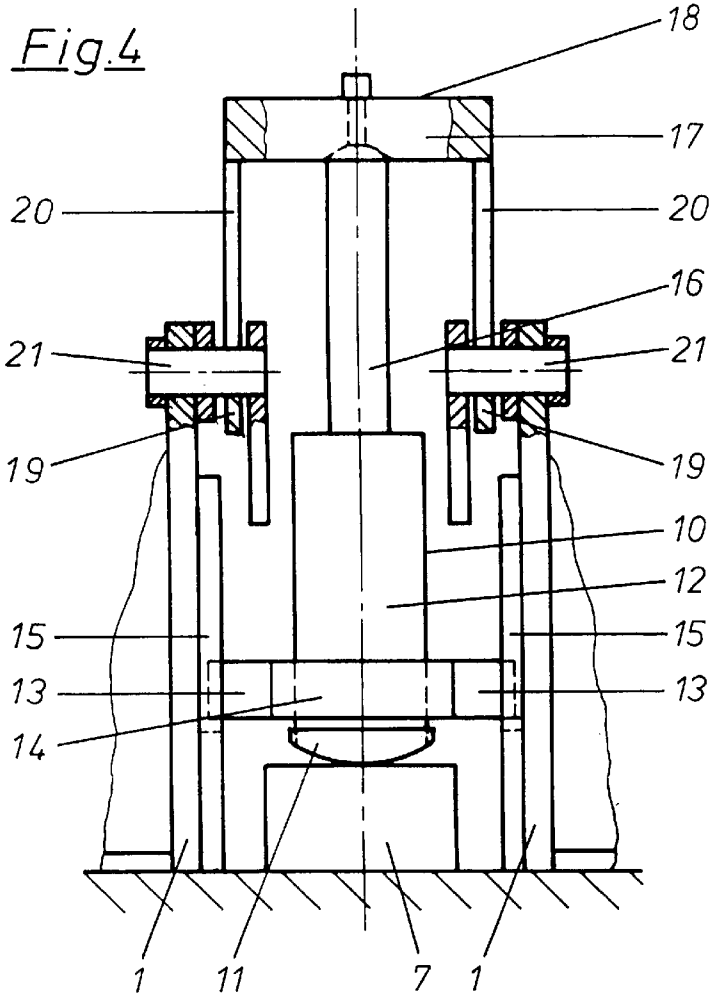
FIG. 4 shows a front view of extended lifting arrangement.

A hydraulic advancing support frame has two base shoes 1, arranged in parallel alongside each other at some distance apart, on which, not shown in the drawing, adjustable-height props to support a roof canopy 2 are mounted. A gob shield 3 is linked to this on the goaf side, which is adjustable in height, guided by the links of a four-link mechanism on the base shoes 1 which is only represented as an indication, not drawn.

A cross beam 4 joins the base shoes 1 together on the face side and forms the abutment for an advancing cylinder 5 pivoted on it between the base shoes 1, with a piston rod 6 which can be extended towards the goaf side. On the goaf side above the ground the piston rod 6 is joined to an advancing rod 7 arranged below the advancing cylinder 5, which is linked vertically via a coupling member 8 to a face conveyor 9 arranged along the face.

The piston rod 6 of the advancing cylinder 5 is extended, when the base shoes 1 of the support are drawn up to the conveyor 9. During mining the conveyor 9 is pushed forward further in the direction of the face with the advancing rod by retracting the piston rod 6 of the advancing cylinder 5. In connection with the mining the advancing support frame, released from the roof is drawn further towards the conveyor, which forms the face side abutment for the advancing assembly, by extending the piston rod 6 of the advancing cylinder 5.

When on even ground, the advancing rod 7, joined by vertical linkage to the conveyor 9 is at the same level as the conveyor 9 and the base shoes 1. During mining work, however, differences of level can arise, because the mining work has cut a higher or lower level, onto which the conveyor 9 is pushed. The following stepping process is hindered above all because the base shoes 1 impact a step in the ground, or sink into soft ground. Assistance is provided by the lifting cylinder 10, with which the base shoes 1 are lifted during the stepping process up to the level on which the conveyor 9 has moved forwards.

The lifting cylinder 10 is supported in an upright position on a ball-shaped mounting 11 on the outer cylinder cover tube 12 in front of the cross beam 4 on a flat formed on the advancing rod 7. It is held so as to be able to slide in height by two outwards facing guide lugs 13, fastened to a ring collar 14 which encircles the cylinder cover tube 12 in a lower region, in vertically directed slotted longitudinal guides 15 in the opposing inner sides of the base shoes 1. The piston rod 16 of the lifting cylinder 10 centrally supports the cross bar 17 of a U shaped tension stirrup 18, whose lower shanks 19 directed towards the ground are provided with elongated holes 20.

The tension stirrup 18 is guided by carrying bolts 21, which are attached above the longitudinal guides 15 to both inner sides of the base shoes 1 and engage in the vertical elongated hole openings 20 with the shanks 19 of the tension stirrup 18, similarly adjustable in height in relation to the base shoes 1. In this way both the lifting cylinder 10 with the covering tube 12 can be moved via the sliding guide lugs 13 in the longitudinal guides 15 and also with the piston rod 16 via the carrying bolts 21 engaging in the elongated holes 20 in a vertical direction.

During mining the advancing rod 7 attached to the face conveyor 9 is pushed forward relative to the base shoes 1 in the direction of the face by the retracting piston rod of the advancing cylinder 5. The lifting cylinder 10 is kept unloaded by cross forces through the guide lugs 13, on the cylinder cover 12 with the ring collar 14, in the longitudinal guides 15 and slides with the ball-shaped mounting 11 over the flat portion of the advancing rod 7. The ball-shaped mounting 11 is formed from an interchangeable cap gripping around the lower part of the cover tube 12 and comprises a softer material than the advancing rod 7.

Figure 3:
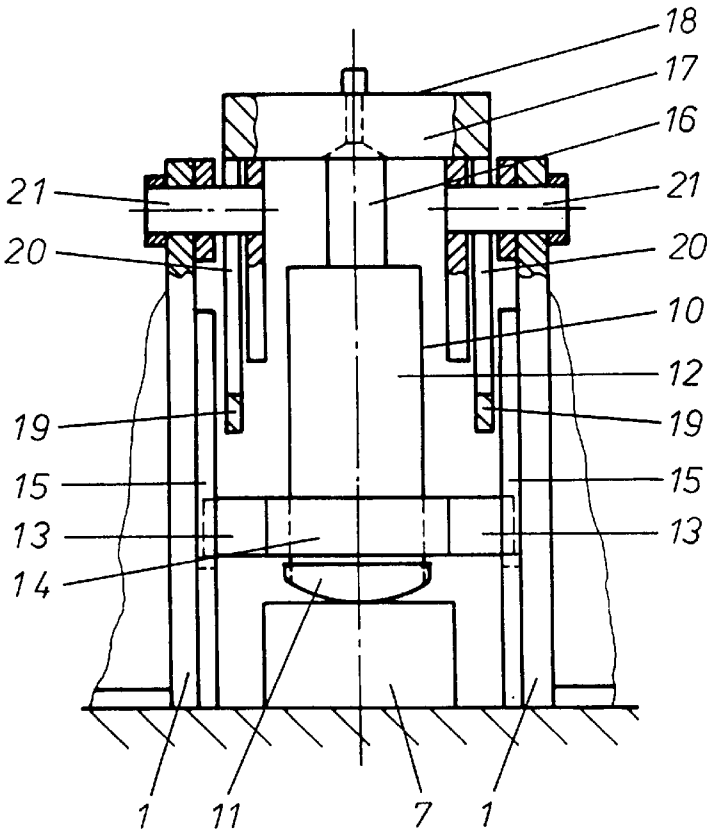
FIG. 3 shows a front view of retracted lifting arrangement.
Figures 5A, 5B, 5C, 5D:
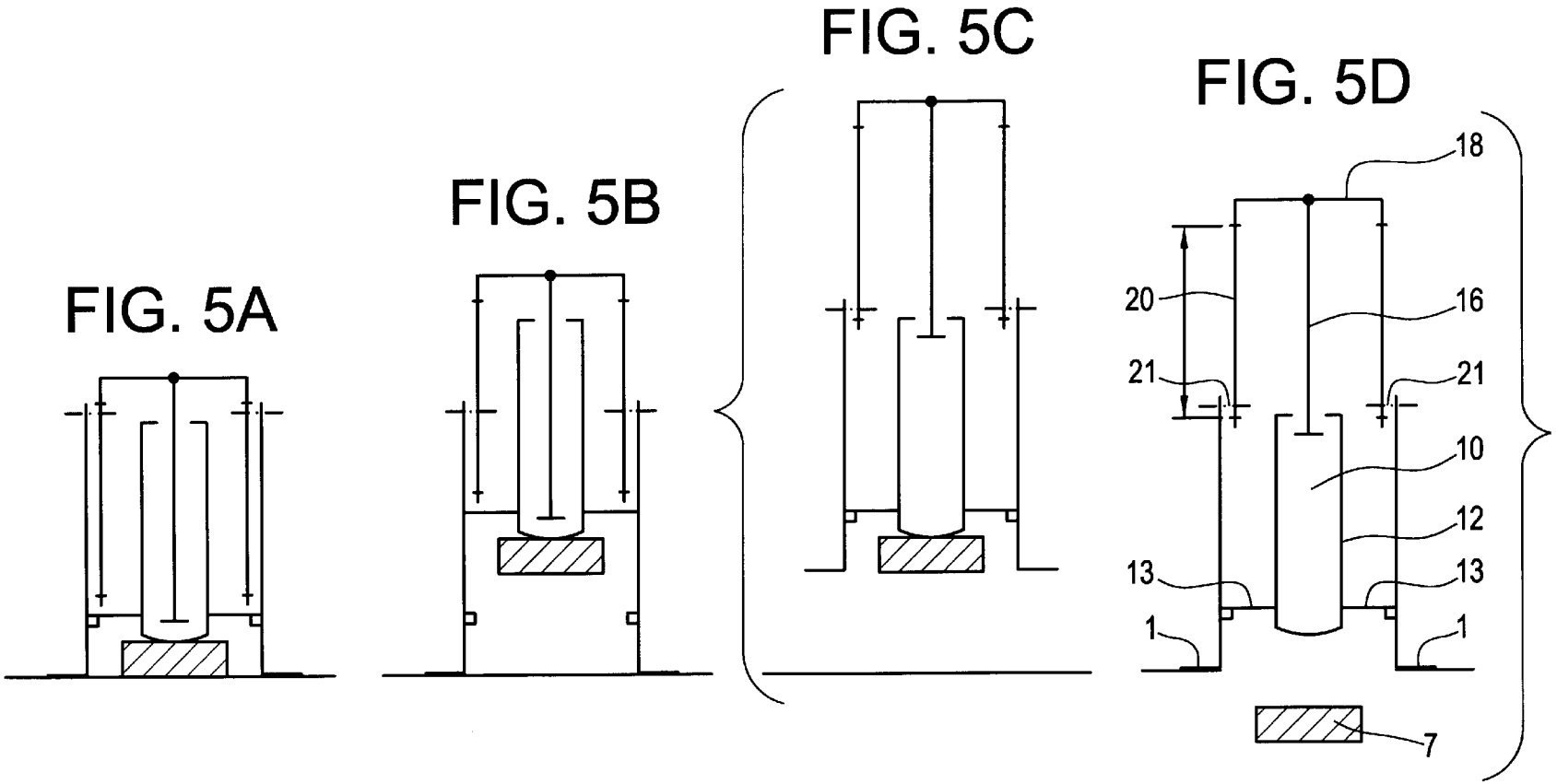
FIG. 5 shows schematic views of the adjustment range of the lifting arrangement.

In FIG. 5 the lifting arrangement is shown in four different positions in relation to the advancing rod 7. FIG. 5*a,* corresponding to FIG. 3, shows the base shoes 1 and the advancing rod 7 arranged between them, at the same level. The piston rod 16 of the lifting cylinder 10 is retracted and the carrying bolts 21 are in the upper region of the elongated holes 20 of the tension stirrup 16. The two guide lugs 13 of the cylinder cover tube 12 are in their lowest position in the longitudinal guides 15 against stops which are not drawn.

In FIG. 5*b* the advancing rod 7 is raised somewhat with respect to the base shoes, whereby the highest position is not shown. The lifting cylinder 10 is pushed upwards in the longitudinal guides 15, with its piston rod 16 retracted. The carrying bolts 21 are correspondingly moved in the elongated holes 20.

The piston rod 16 of the lifting cylinder 10 is extended in FIG. 5*c*. The tension stirrup 18 is pushed up and has engaged the carrying bolts 21 in the elongated holes 20 are drawn upwards such that the base shoes 1 are raised to the level of the advancing rod 7.

FIG. 5*d* shows an advancing rod 7 which has dropped down. The lifting cylinder 10 lies with the guide lugs 13 on the stops in the longitudinal guides 15 and has no function, even with the piston rod 16 extended.

I claim:

1. A hydraulic advancing support frame with two parallel base shoes as the mounting for a prop supporting a roof canopy, with an advancing cylinder supported on a cross-beam between the base shoes, whose extensible piston rod engages on the goaf side with an advancing rod, which is taken below the advancing cylinder and is linked on the face side to a face conveyor, and with a lifting cylinder supported on the advancing rod in an upright position for lifting the base shoes during the advancing process, in which the lifting cylinder is mounted in side guides on the base shoes so as to be able to slide in height and joined to said side guides via a U-shaped tension stirrup, which is supported centrally by the lifting cylinder.

2. The hydraulic advancing support frame according to claim 1 further including a cylinder cover tube, in which the lifting cylinder is held by lateral guide lugs on the cylinder cover tube in vertically arranged longitudinal guides on the opposing inner sides of the base shoes so that it can slide in height and in which above the longitudinal guides carrying bolts fixed on the inner sides of the base shoes engage in elongated holes in shanks of the tension stirrup directed towards the ground on both sides of the lifting cylinder.

3. The hydraulic advancing support frame according to claim 2, in which the elongated holes in the tension stirrup have a length corresponding to the range of the lifting cylinder.

4. The hydraulic advancing support frame according to claim 3 in which the lifting cylinder is arranged on the face side of the cross beam.

5. The hydraulic advancing support frame according to claim 2, in which the lifting cylinder is arranged on the face side of the cross beam.

6. The hydraulic advancing support frame according to claim 1, in which the lifting cylinder is arranged on the face side of the cross beam.

* * * * *